US006871933B2

(12) United States Patent
Li

(10) Patent No.: US 6,871,933 B2
(45) Date of Patent: Mar. 29, 2005

(54) INK JET PRINT HEAD IDENTIFICATION CIRCUIT AND METHOD

(75) Inventor: Chi-Lung Li, Hsinchu (TW)

(73) Assignee: International United Technology Co., Ltd., Hsinchu (TW)

( * ) Notice: Subject to any disclaimer, the term of this patent is extended or adjusted under 35 U.S.C. 154(b) by 47 days.

(21) Appl. No.: 10/622,912

(22) Filed: Jul. 15, 2003

(65) Prior Publication Data

US 2004/0179054 A1 Sep. 16, 2004

(30) Foreign Application Priority Data

Mar. 13, 2003 (TW) ..... 92105458 A

(51) Int. Cl.[7] ..... B41J 29/393
(52) U.S. Cl. ..... 347/19; 400/175
(58) Field of Search ..... 347/19; 400/175

(56) References Cited

U.S. PATENT DOCUMENTS 4,827,257 A * 5/1989 Kortegaard ..... 340/825.65
4,930,915 A * 6/1990 Kikuchi et al. ..... 400/175
5,363,134 A * 11/1994 Barbehenn et al. ..... 347/49
5,504,507 A * 4/1996 Watrobski et al. ..... 347/19
5,757,394 A * 5/1998 Gibson et al. ..... 347/19
5,940,095 A * 8/1999 Parish et al. ..... 347/19
6,022,094 A * 2/2000 Gibson et al. ..... 347/19
6,325,483 B1 * 12/2001 Harbour et al. ..... 347/19
6,568,783 B2 * 5/2003 Hu et al. ..... 347/19
6,568,785 B1 * 5/2003 Edelen et al. ..... 347/19
6,601,940 B2 * 8/2003 Akama et al. ..... 347/19
6,719,397 B1 * 4/2004 Hu et al. ..... 347/19

FOREIGN PATENT DOCUMENTS

JP 2000158664 A * 6/2000 ..... B41J/2/175

* cited by examiner

*Primary Examiner*—Lamson Nguyen
*Assistant Examiner*—Blaise Mouttet
(74) *Attorney, Agent, or Firm*—J.C. Patents

(57) ABSTRACT

An identification circuit for identifying the type of an ink jet print head and method thereof is disclosed. A reset signal and at least a clock signal are provided. A count value is reset if the identification circuit receives a reset signal. The count value is counted to next value if the identification circuit receives a corresponding clock signal. A logic circuit is programmed to output the required identification code sequentially from the ink jet print head according to the required identification code designated for the ink jet print head and the count value.

17 Claims, 5 Drawing Sheets

INK JET PRINT HEAD IDENTIFICATION CIRCUIT AND METHOD

CROSS-REFERENCE TO RELATED APPLICATION

This application claims the priority benefit of Taiwan application Ser. No. 92105458, filed Mar. 13, 2003.

BACKGROUND OF THE INVENTION

1. Field of Invention

The present invention generally relates to an ink jet print head, and more particularly, to an identification circuit for the ink jet print head and a method thereof.

2. Description of Related Art

Different types of computer peripheral products have been developed and are now widely accepted. For ink jet printers, in order to fulfill different printing requirements for users working in different environments, different types of ink jet printers have been developed. However, each ink jet printer has different types of the ink jet print heads that correspond to it, for example, an ink jet print head with a black cartridge or color cartridge, and ink jet print heads with different number of injection nozzles.

In order to identify the types of the ink jet print head, an identification code corresponding to its model or serial number is given to each ink jet print head when it is manufactured, so that the ink jet printer can identify different types of ink jet print heads when they are installed onto the ink jet printer, so as to use different control programs to control the ink jet print heads of different models or serial numbers.

As described above, since there are many types of the ink jet print heads, an identification circuit that reads one or identification codes corresponding to its model or serial number had better be designed into the ink jet print head to provide the ink jet printer to identify different types of the ink jet print heads installed thereon. Since the identification circuit of the ink jet print head is only used at the moment of the ink jet print head being installed in the ink jet printer or before the first printing operation is started, and once the ink jet print head is identified, the identification circuit can be no longer used. Therefore, it is common that the identification circuit of the ink jet print head reads the identification code stored in the ink jet print head by using the address lines of the print head array.

FIG. 1 schematically shows a block diagram of an ink jet printer identification system. As shown in the drawing, the ink jet printer identification system 100 comprises printer electronics 110 and print head electronics 120, wherein the printer electronics 110 and the print head electronics 120 are connected with each other via a plurality of address lines 131 and a temperature sensing output line 132. The printer electronics 110 comprise a controller 111 and a driving circuit 112, and the print head electronics 120 comprise a print head array 121, an identification circuit 122, and a temperature sensing circuit 123.

When it is printing, the controller 111 transmits the data being printed to the driving circuit 112, and the driving circuit 112 drives the address lines 131, so as to control the print head array 121 to print out the required patterns. The temperature sensing circuit 123 senses the temperature of the print head, and transmits it to the controller 111 via the temperature sensing output line 132. The identification circuit 122 connected to part of the address lines 131 and is used to have the controller 111 send out a control signal for reading out the stored identification code, and to output the stored identification code via the temperature sensing output line 132.

There are several types of the identification circuits in the prior art, the one shown in FIG. 2 is one identification circuit disclosed by U.S. Pat. No. 5,363,134. As shown in the drawing, the identification circuit 200 comprises a plurality of programmable fuses F1~F13 and a plurality of transistors Q1~Q13. One end of each of the fuses F1~F13 is coupled to a corresponding gate of the transistors Q1~Q13, so as to control the "ON" or "OFF" of the transistors Q1~Q13. The identification code corresponding to the type of the ink jet print head using this identification circuit 200 is stored via the programmable fuses F1~F13. Whether each of the fuses F1~F13 is fused or not represents a bit data of the identification code, respectively.

When the printer intends to read the identification code, a high level reading control signal is sent out via the address lines 131. Here, it is assumed that the high level reading control signal is sent out from A13. If the fuse F13 is reserved, the transistor Q13 is ON, therefore, the temperature sensing output line 132 is dropped down to a low level for reading an identification code of "0". On the contrary, if the fuse F13 is fused when it is programmed, the transistor Q13 is OFF, and the temperature sensing output line 132 is pulled up to a high level by the pull-up resistor (not shown) of the printer electronics 10 in FIG. 1. Therefore, an identification code of "1" is read out, and the method mentioned above can be used to sequentially read out other bits of the identification code.

Each address line of such type of the identification circuit 200 can only read out one corresponding bit of the identification code. Therefore, the quantity of the bits in the identification code that can be stored in the print head is limited by the number of the address lines, so it is hard to expand.

FIG. 3 shows the other identification circuit disclosed by U.S. Pat. No. 5,940,095. The identification circuit 300 mainly comprises a plurality of one-bit shift registers 320*a*, 320*b*, 320*c*, and 320*d* for achieving the object of implementing a parallel in, serial out identification circuit. That is, when the printer electronics 110 in FIG. 1 transmits a loading control signal "Load" via the address line 325, the stored identification code is loaded in parallel to the plurality of one-bit shift registers 320*a*, 320*b*, 320*c*, and 320*d*. Then, when a first clock signal clk1 and a second clock signal clk2 are sequentially received via the address line 326 and 327, respectively, the bit data stored in the one-bit shift register 320*d* is shifted out via the output line 328. Then, the bit data stored in the one-bit shift register 320*c* is shifted into the one-bit shift register 320*d*, the bit data stored in the one-bit shift register 320*b* is shifted into the one-bit shift register 320*c*, and the bit data stored in the one-bit shift register 320*a* is shifted into the one-bit shift register 320*b*.

Therefore, after the printer electronics 110 transmits the loading control signal "Load", and sequentially transmits the required first clock signal clk1 and the required second clock signal clk2 via the address line 326 and 327, respectively, the identification code stored in the plurality of one-bit shift registers 320*a*, 320*b*, 320*c*, and 320*d* is output sequentially. Therefore, such parallel in, serial out identification circuit 300 is able to expand the bit number of the identification code based on the requirements with only small number of the address lines, such as 325, 326, and 327, so that it is not limited by the number of the address lines.

However, the identification circuit that is able to expand the bit number of the identification code and not be limited by the number of the address lines, is not limited in implementation to the parallel in, serial out identification circuit by using the shift register mentioned above.

SUMMARY OF THE INVENTION

To solve the problem mentioned above, the present invention provides an identification circuit for identifying the ink jet print head and a method thereof. The bit number of the identification code can be expanded based on the requirements, and it is not limited by the number of the address lines.

In order to achieve the object mentioned above and others, the present invention provides an identification circuit for identifying the ink jet print head, wherein the identification circuit is suitable for use in an ink jet printer that comprises a reset signal line, at least one clock signal line, and an identification code signal line, so as to identify the type of the installed ink jet print head. The identification circuit comprises a counter, a logic unit, and a programming unit.

The counter is coupled to the reset signal line and at least one clock signal line. The counter is reset when the reset signal is received by the reset signal line, and the count value is counted to the next value when a corresponding clock signal is received by at least one clock signal line, so as to output it from a plurality of output terminals of the counter.

The logic unit comprises a plurality of input terminals and an output terminal. The output terminal is coupled to an identification code signal line, so as to output the identification code that represents the type of the ink jet print head. The programming unit is coupled to the output terminals of the counter and the input terminals of the logic unit. The programming unit is used for programming a corresponding connection between each output terminal of the counter and the input terminals of the logic unit.

In an embodiment, after the counter is reset, the counter is counted in a sequence of 1, 2, 4, 8, 16, . . . , to count its count value.

In an embodiment, the logic unit may be an OR gate, and the OR gate may comprise an enabling control terminal for accepting the control of the clock signal of the clock signal line.

In an embodiment, the programming unit is programmed in a mask programmed way when the identification circuit of the ink jet print head is being manufactured, so as to store the required identification code.

In another embodiment, the programming unit uses fuses to provide the programmable programming unit, so as to store the required identification code.

The present invention further provides an identification circuit for identifying the ink jet print head, wherein the identification circuit is suitable for use in an ink jet printer that comprises a reset signal line, at least one clock signal line, and an identification code signal line, so as to identify the type of the installed ink jet print head. The identification circuit comprises a counter, a plurality of switches, and a programming unit.

The counter is coupled to the reset signal line and at least one clock signal line. The counter is reset when the reset signal is received by the reset signal line, and the count value is counted to next value when a corresponding clock signal is received by the at least one clock signal line, so as to output it from a plurality of output terminals of the counter.

Each of the plurality of switches comprises an input terminal, an output terminal, and a control terminal. The output terminals of all switches are coupled to the identification code signal line, so as to output the identification code that represents the type of the ink jet print head. The control terminal of each switch is coupled to the corresponding output terminal of the counter, so as to accept the control from the output terminal of the counter.

The programming unit coupled to the input terminal of the switch mentioned above is used for programming the input value that is input to the input terminal of the switch according to the identification code to be stored.

In an embodiment, after the counter is reset, the counter is counted in a sequence of 1, 2, 4, 8, 16, . . . , to count its count value.

In an embodiment, the switch is made of a NMOS transistor or a CMOS transistor.

In an embodiment, the programming unit is programmed in a mask programmed way when the identification circuit of the ink jet print head is being manufactured, so as to store the required identification code.

In another embodiment, the programming unit uses fuses to provide the programmable programming unit, so as to store the required identification code.

Based on the spirit of the present invention, the present invention provides an identification method of the ink jet print head. The method is suitable for identifying the ink jet print head and comprises the steps of: providing a reset signal, and at least one clock signal; resetting a count value when the reset signal is received; counting a count value of the counter to next value when the at least one clock signal is received, and programming a logic circuit according to an identification code that represents the type of the ink jet print head and the count value mentioned above, so as to sequentially output the required identification code of the ink jet print head.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention. In the drawings, FIG. 1 schematically shows a block diagram of an ink jet printer identification system.

DESCRIPTION OF THE PREFERRED EMBODIMENTS

Figure 1:
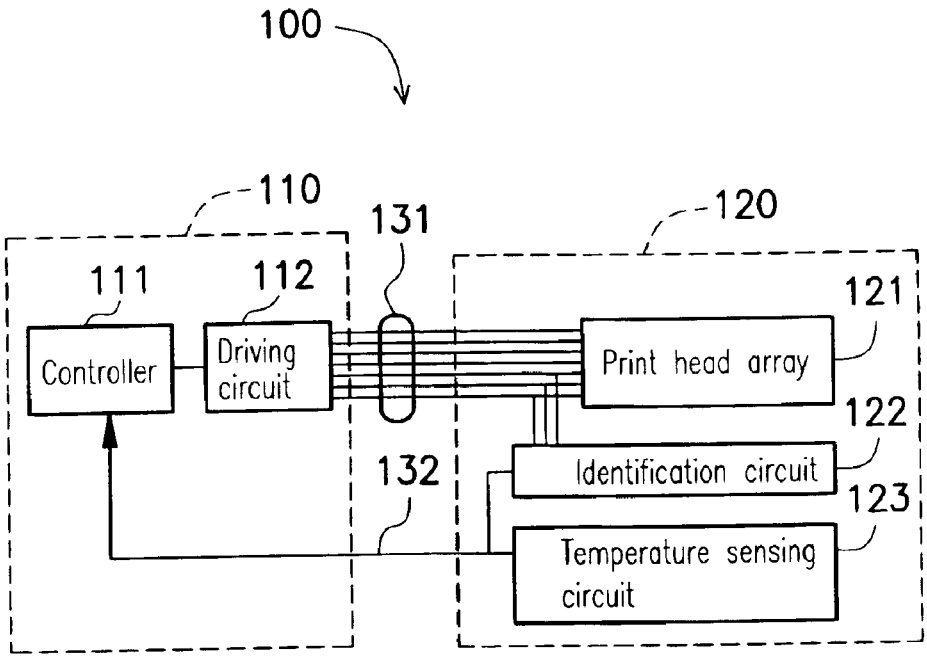
FIG. 1 (PRIOR ART)
Figure 2:
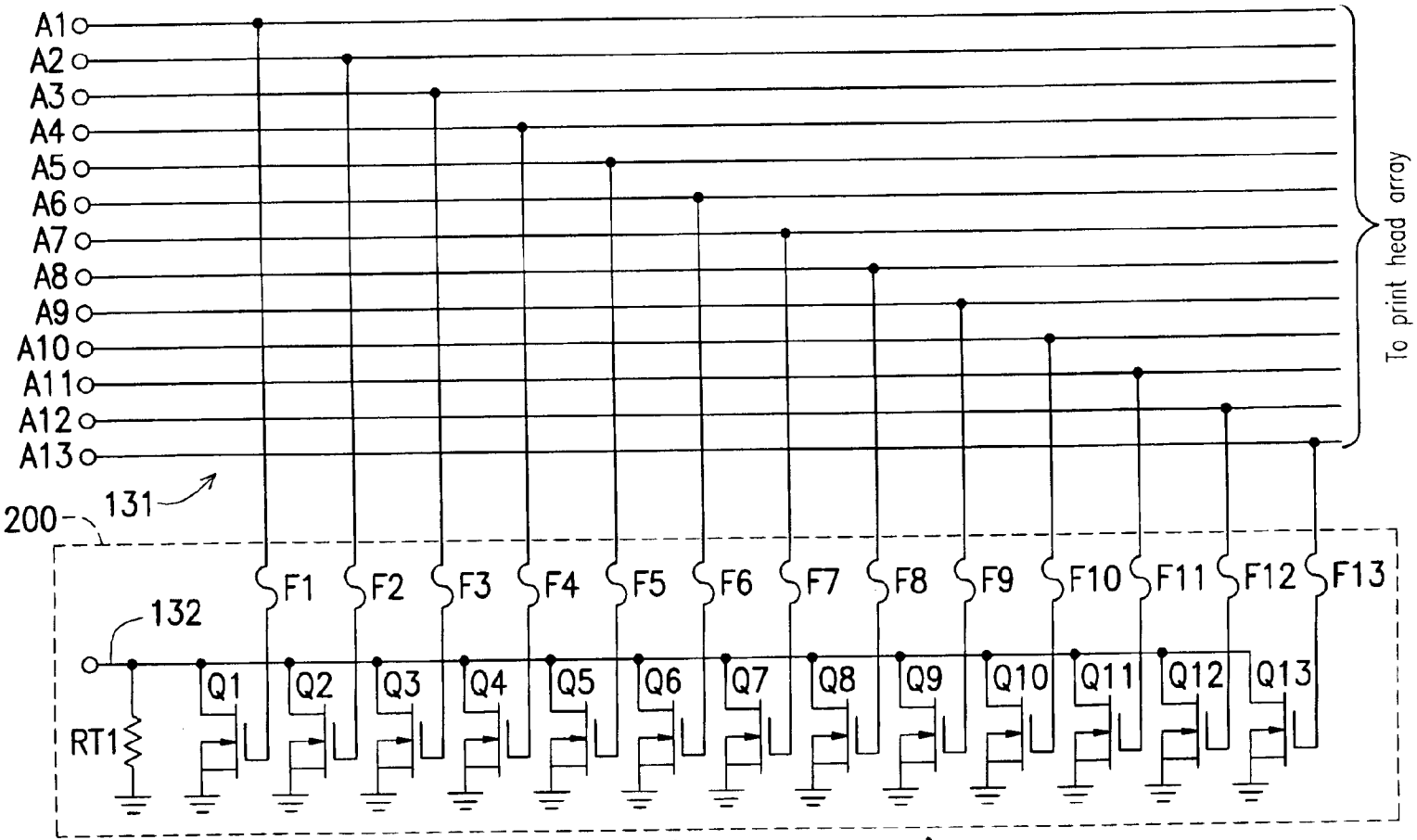
FIG. 2 (PRIOR ART)
FIG. 2 schematically shows a diagram of an identification circuit disclosed by U.S. Pat. No. 5,363,134.
Figure 3:
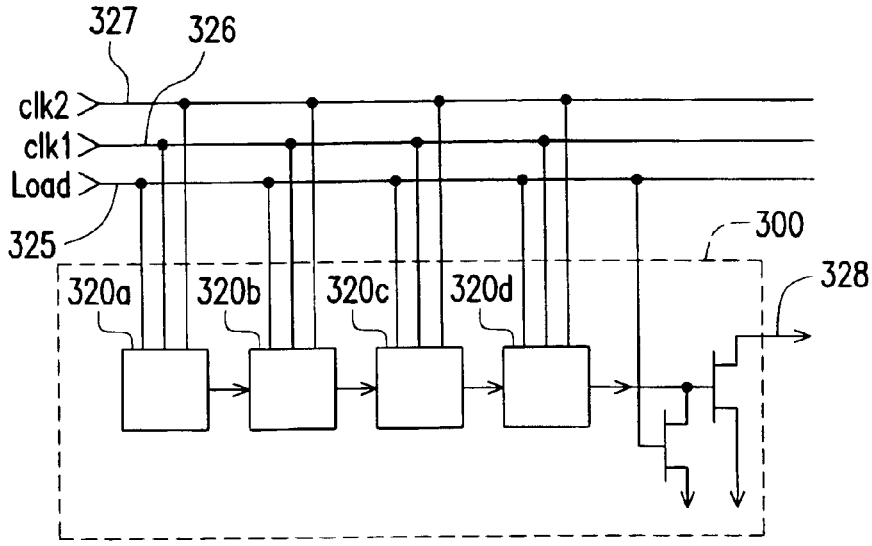
FIG. 3 (PRIOR ART)
FIG. 3 schematically shows a diagram of another identification circuit disclosed by U.S. Pat. No. 5,940,095.
Figure 4:
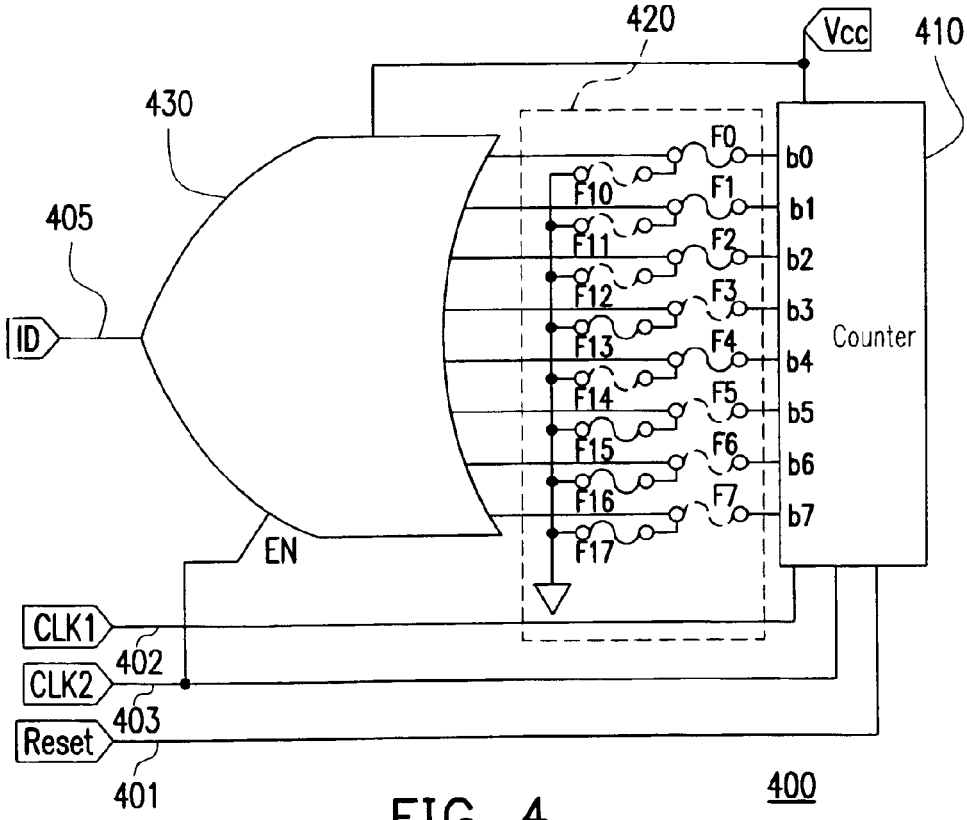
FIG. 4 schematically shows a diagram of an ink jet print head identification circuit of the first embodiment according to the present invention.

FIG. 4 schematically shows a diagram of an ink jet print head identification circuit of the first embodiment according to the present invention. As shown in the drawing, the identification circuit 400 comprises a counter 410; an OR logic unit 430 that is, for example, constituted by an OR gate; and a programming unit 420 that is, for example, constituted by a plurality of fuses. Although fuses are used as the programming unit 420 in the drawing, it will be apparent to one of the ordinary skill in the art that the programming unit 420 also can be programmed in a mask programmed way when the identification circuit 400 of the ink jet print head is being manufactured, optionally, other methods also can be applied, such as laser trimming or fusing. It should be noted that electrical connectors or conductors can be used in the programming unit 420 instead of using fuses.

As shown in FIG. 4, the identification circuit 400 of the ink jet print head only use three address lines of the ink jet printer (not shown): the reset signal line 401 for transmitting the reset signal "Reset", the first clock signal line 402 for transmitting the first clock signal Clk1, and the second clock signal line 403 for transmitting the second clock signal Clk2, to perform the function of identifying the type of the installed ink jet print head. Therefore, the bit number of the identification code can be expanded based on its requirement, and is not limited by the number of the address lines.

The counter 410 is coupled to the reset signal line 401, the first clock signal line 402, and the second clock signal line 403. In the present embodiment, since the bit number required for the identification code is 8 bits, an 8-bit counter having 8 output terminals b0~b7 is used for the required bit number of the identification code. Each of the output terminals b0~b7 is coupled to one input terminal of the OR logic unit 430 via a fuse of the programming unit 420, respectively. Each of the input terminals of the OR logic unit 430 is grounded via a fuse of the programming unit 420, respectively, so that the required identification code can be stored by the programming. Further, the OR gate that constitutes the OR logic unit 430 can further comprise an enabling control terminal EN to accept the control of the second clock signal Clk2 from the second clock signal line 403.

Figure 5:
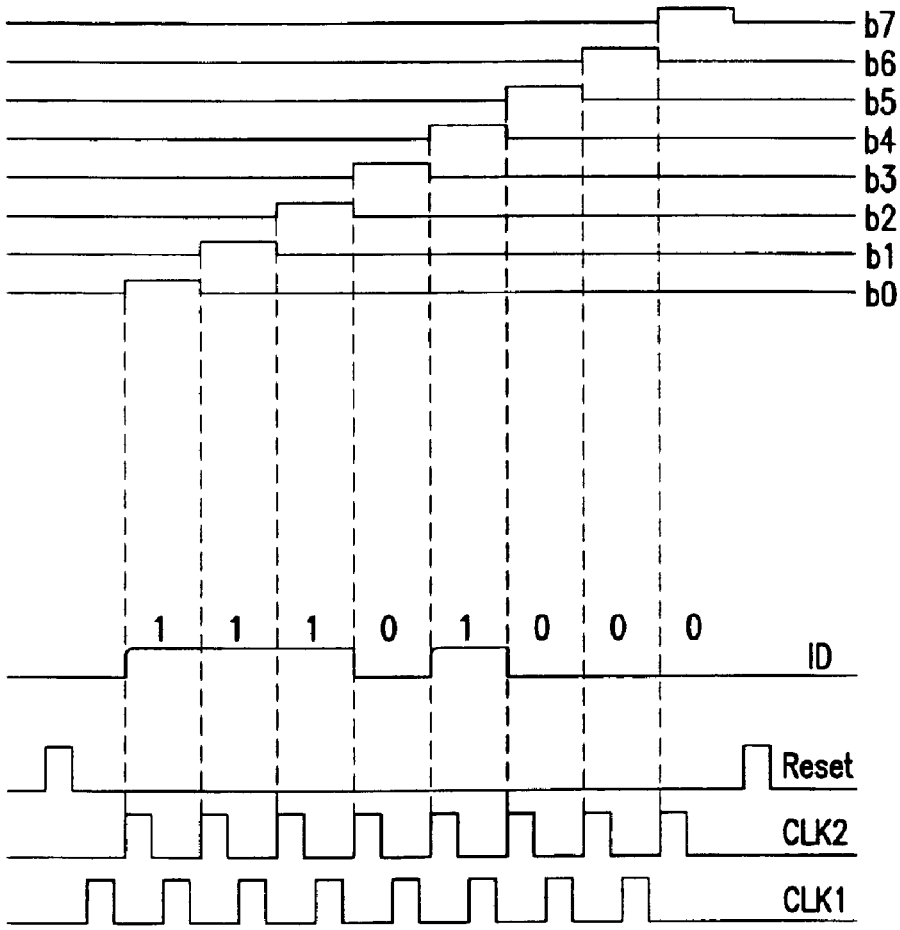
FIG. 5 schematically shows an operation timing diagram of an ink jet print head identification circuit of the first and second embodiments according to the present invention.

If it is assumed that the identification code to be stored is 11101000, the fuse F10, F11, F12, F3, F14, F5, F6, and F7 in the drawing should be fused, and the fuse F0, F1, F2, F13, F4, F15, F16 and F17 in the drawing should be reserved, so that the programming unit 420 can be programmed to store the required identification code. Its operation principle is described hereinafter referring to the operation timing diagram in FIG. 5.

When the counter 410 receives the reset signal "Reset" from the reset signal line 401, the count value of the counter 410 is reset to 0. When the counter 410 sequentially receives a first clock signal Clk1 and a second clock signal Clk2 from the first clock signal line 402 and the second clock signal line 403, respectively, the counter 410 counts its count value in a certain sequence, such as 1, 2, 4, 8, 16, . . . , etc. That is, after the count value of the counter 410 is reset to 0, the output terminals b0~b7 of the counter 410 are sequentially set as a high level "1" when a first clock signal Clk1 and a second clock signal Clk2 are sequentially received from the first clock signal line 402 and the second clock signal line 403, its operation timing is like b0~b7 shown in FIG. 5.

When the output terminal b0 of the counter 410 is set to "1", and the output terminals b1~b7 are "0", since the fuse F0 is reserved when it is programmed, the output terminal of the OR logic unit 430 outputs the identification code ID of "1". When the output terminal b1 of the counter 410 is "1", and the output terminals b0 and b2~b7 are "0", since the fuse F1 is reserved when it is programmed, the output terminal of the OR logic unit 430 outputs the identification code ID of "1". Similarly, when the output terminal b2 of the counter 410 is "1", and the output terminals b0~b1 and b3~b7 are "0", since the fuse F2 is reserved when it is programmed, the output terminal 405 of the OR logic unit 430 outputs the identification code ID of "1". When the output terminal b3 of the counter 410 is "1", and the output terminals b0~b2 and b4~b7 are "0", since the fuse F3 is fused and F13 is reserved when they are programmed, the output terminal of the OR logic unit 430 outputs the identification code ID of "0". In the same way, the output terminal of the OR logic unit 430 sequentially outputs the identification code ID of "11101000", which represents the identification code of the installed ink jet print head, and its operation timing is as the ID shown in FIG. 5.

Figure 6:
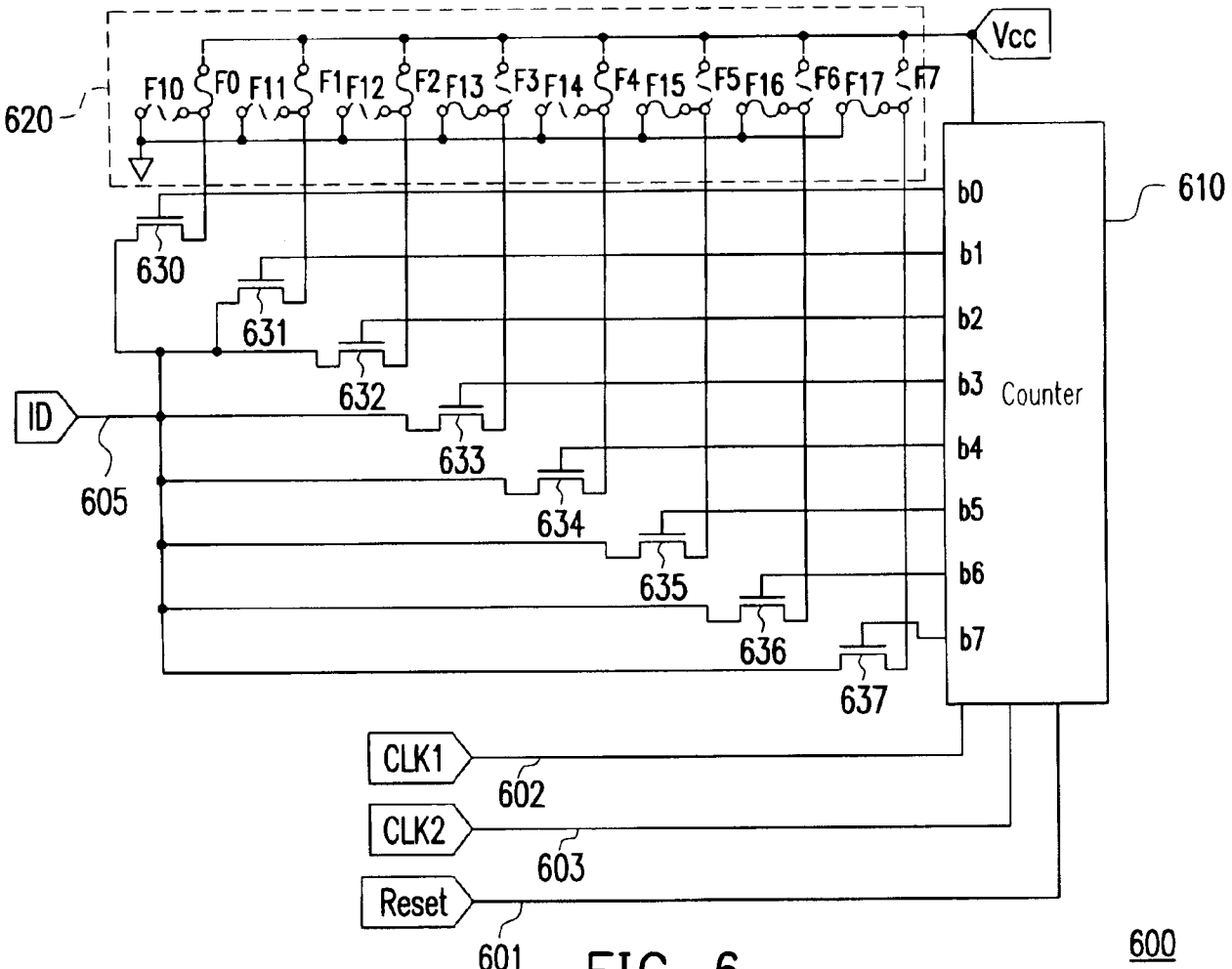
FIG. 6 schematically shows a diagram of an ink jet print head identification circuit of the second embodiment according to the present invention.

FIG. 6 schematically shows a diagram of an ink jet print head identification circuit of the second embodiment according to the present invention. As shown in the drawing, the identification circuit 600 comprises a counter 610; a programming unit 620 that is, for example, constituted by a plurality of fuses; and a plurality of switches 630, 631, 632, 633, 634, 635, 636, and 637 that are, for example, constituted by a plurality of the NMOS transistors. Although fuses are used as the programming unit 620 in the drawing, it will be apparent to one of the ordinary skill in the art that the programming unit 620 also can be programmed in a mask programmed way when the identification circuit 600 of the ink jet print head is being manufactured, optionally, other methods also can be applied, such as laser trimming or fusing. It should be noted that electrical connectors or conductors can be used in the programming unit 420 instead of using fuses.

As shown in FIG. 6, similarly the identification circuit 600 of the ink jet print head only use three address lines of the ink jet printer (not shown): the reset signal line 601 for transmitting the reset signal "Reset", the first clock signal line 602 for transmitting the first clock signal Clk1, and the second clock signal line 603 for transmitting the second clock signal Clk2, to perform the function of identifying the type of the installed ink jet print head. Therefore, the bit number of the identification code can be expanded based on its requirement, and is not limited by the number of the address lines.

The counter 610 is coupled to the reset signal line 601, the first clock signal line 602, and the second clock signal line 603. In the present embodiment, since the bit number required for the identification code is 8 bits, an 8-bit counter having 8 output terminals b0~b7 is used for the required bit number of the identification code. Each of the output terminals b0~b7 is coupled to one gate of the corresponding switches 630, 631, 632, 633, 634, 635, 636, and 637, respectively, so as to control the "ON" or "OFF" of the switches 630, 631, 632, 633, 634, 635, 636, and 637, respectively. A source/drain of each of the switches 630, 631, 632, 633, 634, 635, 636, and 637 is respectively coupled to the power terminal or grounded via the fuse of the programming unit 620, so that the required identification code can be input by the programming. Further, the other source/drain of each of the switches 630, 631, 632, 633, 634, 635, 636, and 637 are coupled together to the identification code signal line 605, so as to output the identification code.

If it is assumed that the identification code to be stored is 11101000, the fuse F10, F11, F12, F3, F14, F5, F6, and F7 in the drawing should be fused, and the fuse F0, F1, F2, F13, F4, F15, F16 and F17 in the drawing should be reserved, so that the programming unit 620 can be programmed to store the required identification code. Its operation principle is described hereinafter referring to the operation timing diagram in FIG. 5.

When the counter 610 receives the reset signal "Reset" from the reset signal line 601, the count value of the counter 610 is reset to 0. When the counter 610 sequentially receives a first clock signal Clk1 and a second clock signal Clk2 from the first clock signal line 602 and the second clock signal line 603, respectively, the counter 610 counts its count value in a certain sequence, such as 1, 2, 4, 8, 16, . . . , etc. That is, after the count value of the counter 610 is reset to 0, the output terminals b0~b7 of the counter 610 are sequentially set as a high level "1" when a first clock signal Clk1 and a second clock signal Clk2 are sequentially received from the first clock signal line 602 and the second clock signal line 603, respectively, its operation timing is like b0~b7 shown in FIG. 5.

When the output terminal b0 of the counter 610 is set to "1", the switch 630 is ON, and since the fuse F0 is reserved when it is programmed, the identification code ID of "1" is output. When the output terminal b1 of the counter 610 is set to "1", the switch 631 is ON, and since the fuse F1 is reserved when it is programmed, the identification code ID of "1" is output. Similarly, when the output terminal b2 of the counter 610 is set to "1", the switch 632 is ON, and since the fuse F2 is reserved when it is programmed, the identification code ID of "1" is output. When the output terminal b3 of the counter 610 is set to "1", the switch 633 is ON, and since the fuse F3 is fused and fuse F13 is reserved when they are programmed, the identification code ID of "0" is output. In the same way, the identification code signal line 605 sequentially outputs the identification code ID of "11101000", which represents the identification code of the installed ink jet print head, and its operation timing is as the ID shown in FIG. 5.

It will be apparent to one of the ordinary skill in the art that the embodiments mentioned above are only some of the embodiments embodied the present invention. For example, the reference number 430 in FIG. 4 can be easily replaced with other logic unit (e.g. NAND logic unit) or decoder. Thus, it is not limited to use the OR logic unit. Similarly, the clock signal lines used in the present invention are not necessarily limited to using two signal lines. Optionally, it is possible to achieve the object and function of the present invention with only one clock signal line. Further, the switches 631~637 in FIG. 6 are not limited to be implemented by the NMOS transistors. Optionally, it is also possible to implement the switches by using the CMOS transistors.

Based on the spirit of the embodiments mentioned above, an identification method of the ink jet print head is concluded. The method is suitable for identifying the ink jet print head and comprises the steps of: providing a reset signal, and at least one clock signal; resetting a count value when the reset signal is received; counting a count value of the counter to next value when the at least one clock signal is received, and programming a logic circuit according to an identification code that represents the type of the ink jet print head and the count value mentioned above, so as to sequentially output the required identification code of the ink jet print head.

Wherein, after the count value is reset to 0, and the first clock signal and the second clock signal are sequentially received, the count value is counted in a certain sequence, such as 1, 2, 4, 8, 16, . . . , etc. Further, the logic circuit may be a logic gate or a plurality of NMOS or CMOS transistors.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. An ink jet print head identification circuit, suitable for using in an ink jet printer that comprises a reset signal line, at least one clock signal line, and an identification code signal line, for identifying a type of the ink jet print head, comprising:

a counter, coupled to the reset signal line and at least one clock signal line, used to reset the counter when a reset signal is received from the reset signal line, and used to count a count value of the counter to a next value when a corresponding clock signal is received from the at least one clock signal line, so as to output the count value from a plurality of output terminals of the counter;

a logic unit, comprising a plurality of input terminals and an output terminal, wherein the output terminal of the logic unit is coupled to the identification code signal line, so as to output an identification code that represents the type of the ink jet print head; and a programming unit, coupled to the output terminals of the counter and the input terminals of the logic unit, used to program the corresponding connection between each output terminal of the counter and each input terminal of the logic unit.

2. The ink jet print head identification circuit of claim 1, wherein, after the counter is reset, the count value of the counter is counted in a sequence of 1, 2, 4, 8, 16, . . . , etc.

3. The ink jet print head identification circuit of claim 1, wherein the logic unit is an OR gate, a NAND gate, or a decoder.

4. The ink jet print head identification circuit of claim 1, wherein the logic unit further comprises an enabling control terminal, and the enabling control terminal is coupled to a clock signal line.

5. The ink jet print head identification circuit of claim 1, wherein the programming unit is programmed in a mask programmed way when the identification circuit of the ink jet print head is being manufactured, so as to store the identification code.

6. The ink jet print head identification circuit of claim 1, wherein the programmable programming unit is provided by using a plurality of fuses, so as to store the identification code.

7. The ink jet print head identification circuit of claim 1, wherein the programmable programming unit is provided by using a plurality of electrical connectors, so as to store the identification code.

8. An ink jet print head identification circuit, suitable for use in an ink jet printer that comprises a reset signal line, at least one clock signal line, and an identification code signal line, for identifying a type of the ink jet print head, comprising:

a counter, coupled to the reset signal line and at least one clock signal line, used to reset the counter when a reset signal is received from the reset signal line, and used to count a count value of the counter to a next value when a corresponding clock signal is received from the at least one clock signal line, so as to output the count value from a plurality of output terminals of the counter;

a plurality of switches, wherein each of the plurality of switches comprises an input terminal, an output terminal, and a control terminal, and all output terminals of the switches are coupled to the identification code signal line, so as to output an identification code that represents the type of the ink jet print head, and each control terminal of the switches is coupled to the corresponding output terminal of the counter, respectively; and a programming unit, coupled to the input terminals of the switches, used to program the input value of the input terminal of the switches according to the identification code to be stored.

9. The ink jet print head identification circuit of claim 8, wherein, after the counter is reset, the count value of the counter is counted in a sequence of 1, 2, 4, 8, 16, . . . , etc.

10. The ink jet print head identification circuit of claim 8, wherein the switches are a plurality of NMOS transistors or a plurality of CMOS transistors.

11. The ink jet print head identification circuit of claim 8, wherein the programming unit is programmed in a mask programmed way when the identification circuit of the ink jet print head is being manufactured, so as to store the identification code.

12. The ink jet print head identification circuit of claim 8, wherein the programmable programming unit is provided by using a plurality of fuses, so as to store the identification code.

13. The ink jet print head identification circuit of claim 8, wherein the programmable programming unit is provided by using a plurality of electrical connectors, so as to store the identification code.

14. An ink jet print head identification method, suitable for identifying a type of the ink jet print head, comprising:

providing a reset signal and at least one clock signal;

resetting a count value when the reset signal is received;

counting the count value to a next value when the at least one clock signal is received; and programming a logic unit according to an identification code that represents the type of the ink jet print head and the count value, so that the ink jet print head sequentially outputs the identification code.

15. The ink jet print head identification method of claim 14, wherein, after the counter is reset, the count value of the counter is counted in a sequence of 1, 2, 4, 8, 16, . . . , etc.

16. The ink jet print head identification method of claim 14, wherein the logic unit is an OR gate, a NAND gate, or a decoder.

17. The ink jet print head identification method of claim 14, wherein the logic circuit unit is a plurality of NMOS transistors or a plurality of CMOS transistors.

* * * * *